US007779560B2

(12) United States Patent
Kay

(10) Patent No.: US 7,779,560 B2
(45) Date of Patent: Aug. 24, 2010

(54) CLEAT PROTECTOR SHOE COVER

(75) Inventor: Richard Keith Kay, Santa Monica, CA (US)

(73) Assignee: Cleatskins, Inc., Encinitas, CA (US)

( * ) Notice: Subject to any disclaimer, the term of this patent is extended or adjusted under 35 U.S.C. 154(b) by 797 days.

(21) Appl. No.: 11/476,340

(22) Filed: Jun. 27, 2006

(65) Prior Publication Data

US 2007/0006490 A1 Jan. 11, 2007

Related U.S. Application Data

(60) Provisional application No. 60/694,582, filed on Jun. 27, 2005.

(51) Int. Cl.
*A43B 5/18* (2006.01)
*A43B 1/10* (2006.01)

(52) U.S. Cl. ..... 36/135; 36/7.3

(58) Field of Classification Search ..... 36/135, 36/7.3, 7.5, 7.6
See application file for complete search history.

(56) References Cited

U.S. PATENT DOCUMENTS

| | | | | |
|---|---|---|---|---|
| 2,032,052 A | | 2/1936 | Friedenberg | |
| 2,801,478 A | * | 8/1957 | Gilbert | 36/7.5 |
| 3,313,047 A | * | 4/1967 | Svien | 36/7.3 |
| 3,821,858 A | | 7/1974 | Haselden | |
| 3,858,336 A | | 1/1975 | Brown | |
| 4,055,005 A | | 10/1977 | Meinhart | |
| 4,183,157 A | * | 1/1980 | Counselman | 36/135 |
| 4,326,345 A | | 4/1982 | Sbicca | |
| 4,693,019 A | | 9/1987 | Kim | |
| 5,172,496 A | | 12/1992 | Vemi | |
| 5,315,767 A | * | 5/1994 | Bradbury | 36/7.1 R |
| 5,548,910 A | | 8/1996 | Klingseis | |
| 2005/0022426 A1 | | 2/2005 | Clark et al. | |
| 2006/0288615 A1 | | 12/2006 | Scheufele et al. | |
| 2007/0113424 A1 | * | 5/2007 | Bell | 36/7.3 |

FOREIGN PATENT DOCUMENTS

| | | |
|---|---|---|
| WO | WO 96/34542 | 11/1996 |
| WO | WO 03/043453 A1 | 5/2003 |

* cited by examiner

*Primary Examiner*—Ted Kavanaugh
(74) *Attorney, Agent, or Firm*—Christie, Parker & Hale, LLP

(57) ABSTRACT

A cleat protector shoe cover. The cleat protector shoe cover has an upper portion formed of either engagements or an elastic material and having a shoe opening formed in a top thereof. The cleat protector shoe cover is stretchable and engages with a cleated shoe to prevent the cleats from being damaged or damaging a floor surface by providing seating areas.

4 Claims, 14 Drawing Sheets

CLEAT PROTECTOR SHOE COVER

CROSS-REFERENCE TO RELATED APPLICATION(S)

This application claims the benefit of U.S. provisional application Ser. No. 60/694,582, filed on Jun. 27, 2005.

SUMMARY OF THE INVENTION

This invention relates to the field of footwear, and more particularly to a shoe cover that protects cleats or spikes on footwear when not used on grassy or soft ground surfaces, as well as protecting floor surfaces from being damaged by the cleats.

In a variety of sports such as track and field, baseball, football, soccer, rugby, lacrosse and golf, to name a few, shoes are provided with cleats or spikes extending downwardly from the bottom of the soles. Cleats or spikes were previously made of metal, but now are more commonly made of hard plastic. These cleats or spikes provide the user with additional traction on sport fields and tracks. However, the cleats can be damaged by walking on abrasive and hard surfaces such as sidewalks and streets. Moreover, the cleats can damage more delicate floor surfaces such as wood floors and interior carpeting.

Accordingly, players commonly bring their sports shoes with cleats or spikes, along with a pair of walking shoes without cleats that the player can wear when not using the shoes with cleats. However, sometimes players forget to bring cleatless or spikeless shoes or do not to remove their shoes with cleats after use on the field and thus the cleats either wear excessively fast, or the ground surface, such as the carpet of a car or the floor of a building becomes dirty or scraped.

It would accordingly be useful to have a cleat protector shoe cover that protects both the cleats or spikes on the cleated or spiked shoes and protects the floor, and does so in an economical, comfortable and functional manner.

DETAILED DESCRIPTION OF THE INVENTION

Figure 1:
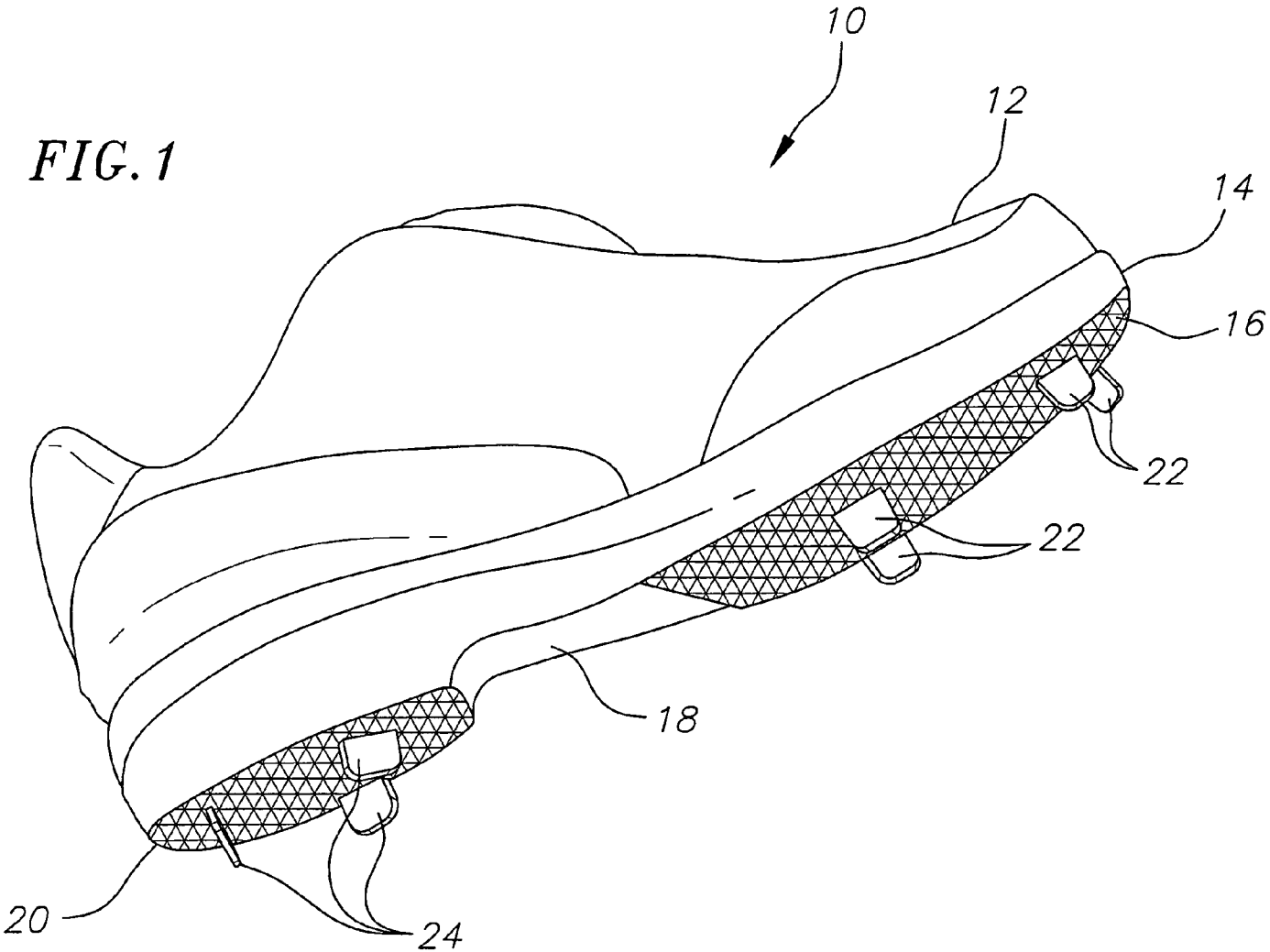
FIG. 1 is a bottom left view of an exemplary cleated shoe.

FIG. 1 is a bottom left view of an exemplary cleated shoe 10. It has an upper 12 with a sole 14 attached to a lower side thereof. The sole 14 has a ball portion 16, a mid-portion 18 in the vicinity of the arch, and a heel portion 20. Cleats 22 extend downwardly from the bottom of the sole in the ball portion 16 and cleats 24 extend downwardly from the bottom sole in the heel portion 20. Typically, the cleats 22 and 24 will not extend into the arch area 18 of the shoe. The cleats 22 and 24 can be made of metal, plastic, hard rubber, or any other desired materials and may be detachably attached to the sole 14. The exemplary cleated shoe 10 shown is for illustrative purposes only and other cleated shoes can be used as well. Moreover, uses of the term "cleats" is meant to encompass any protrusion extending downwardly from shoes that is meant to provide better stability and grip such as cleats, spikes and knobs.

Figure 2:
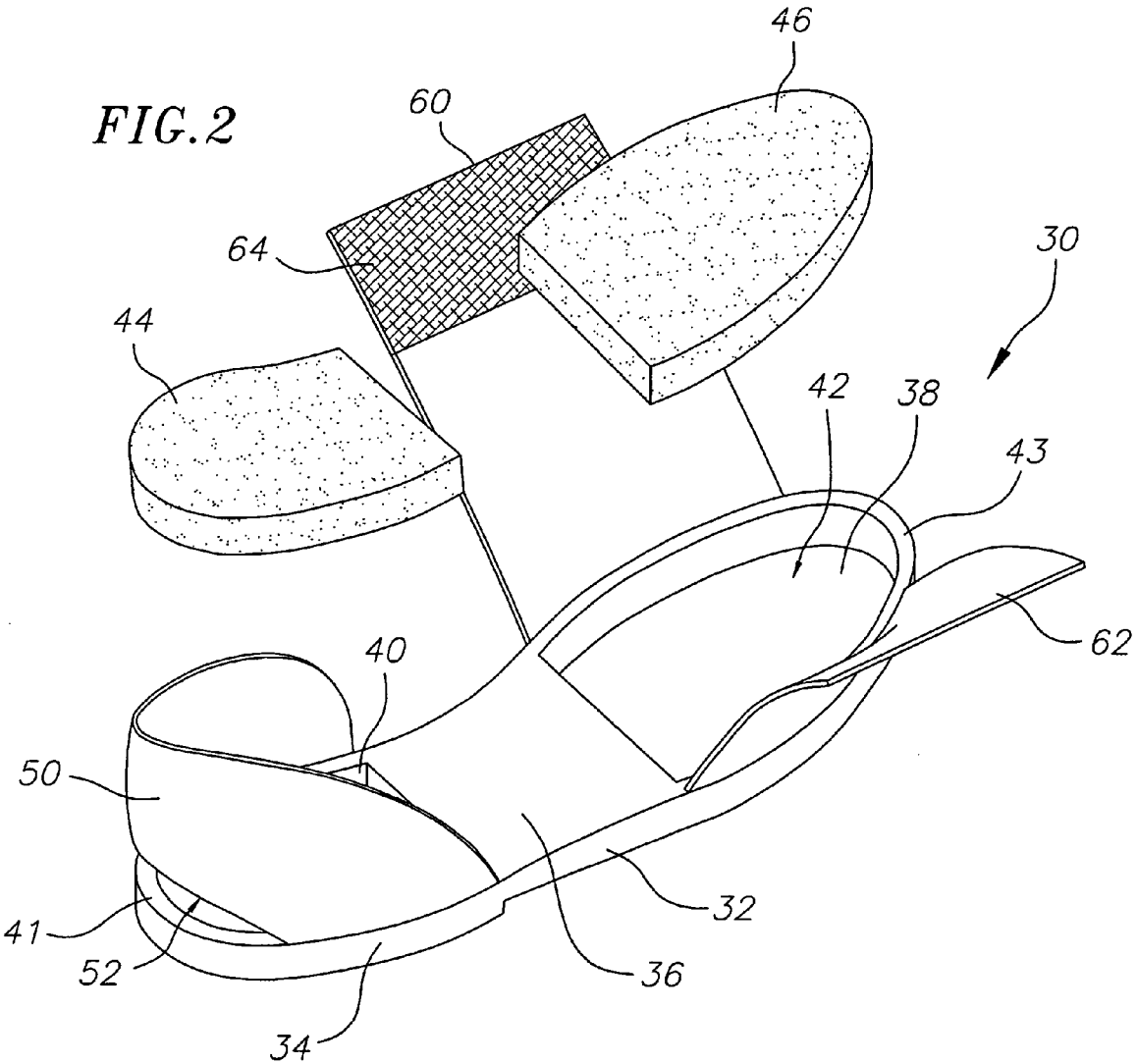
FIG. 2 is a top perspective exploded view of one exemplary cleat protector shoe cover of the invention with its cleat conforming pads removed from the base portion of the cleat protector shoe cover and with its retention straps disengaged from each other.
Figure 3:
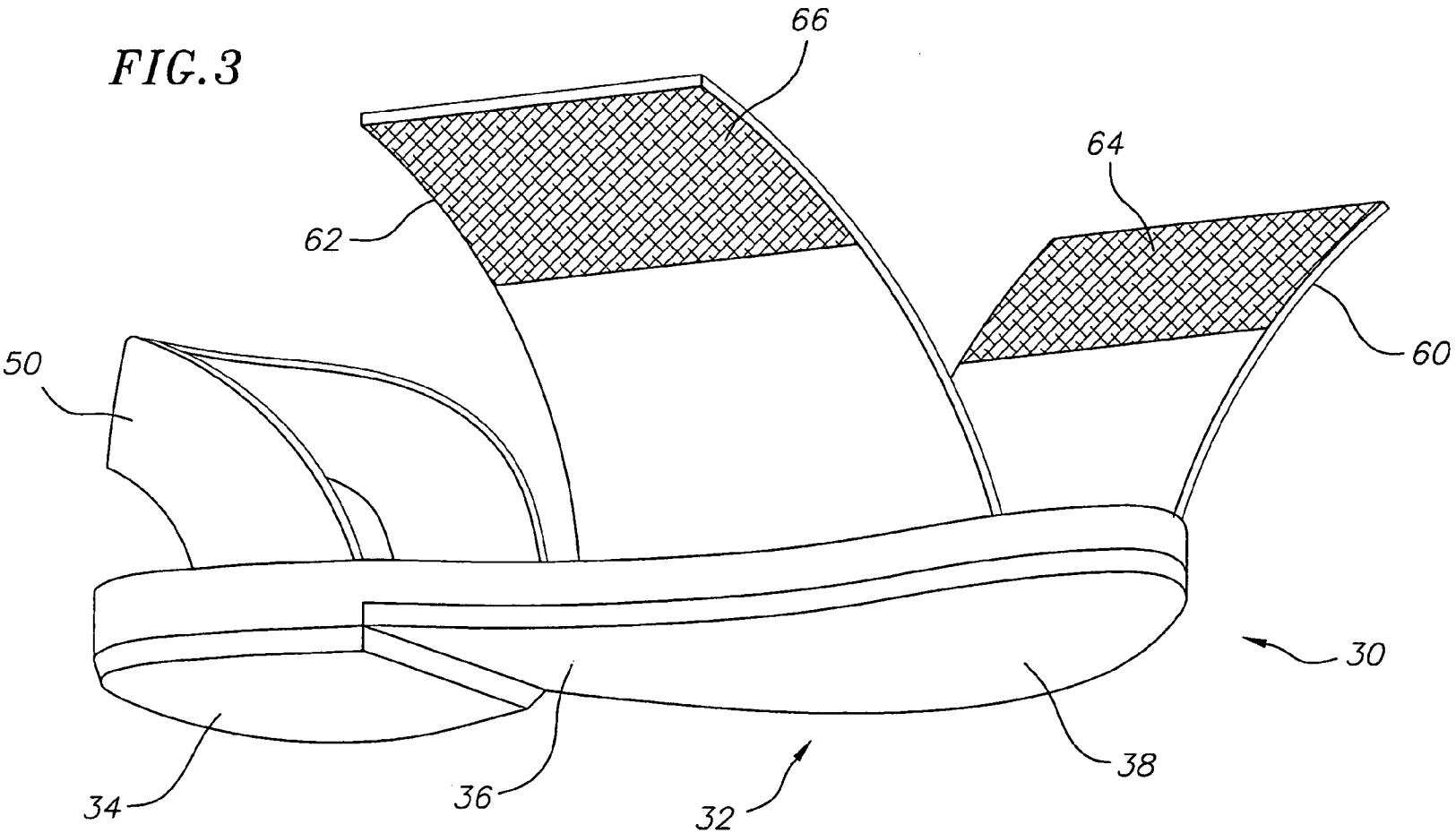
FIG. 3 is a lower right side of the protector footwear of the invention in its open position with its retention straps disengaged from each other.

FIG. 2 is a top perspective view of an exemplary cleat protector shoe cover 30 of the invention. It has a sole 32 with a heel area 34, an arch area 36 and a ball area 38. The heel area 34 and the ball area 38 can have recesses 40 and 42, respectively, formed in an upper part therein. Elastomeric cleat conforming pads 44 and 46 are located and preferably are permanently attached within the recesses 40 and 42, respectively. In the alternative, the sole can be formed together with elastomeric cleat conforming pads 44 and 46 integrally formed therein, such as by molding the material of the elastomeric cleat conforming pads 44 and 46 with other parts of the sole. The arch area 36 can preferably have an upper surface that sits higher than the recesses 40 and 42 and can be formed of a stiffer material than the elastomeric cleat conforming pads 44 and 46. Thus, when the elastomeric pads 44 and 46, respectively, are located and preferably permanently attached in the recesses 40 and 42, the top of the arch area 36 and the top of the elastomeric cleat conforming pads 44 and 46 are about level, thus providing a relatively flat surface. Around the perimeter of the front recess 42, a rim 43 of more resilient material than the elastomeric cleat conforming pad 46, e.g., an extension from the sole 32, can be provided to retain the elastomeric cleat conforming pad 46. Around the heel recess 40, a rim 41 of the more resilient material than the elastomeric pads 46, e.g., an extension from the sole 32, may be provided to retain the pad of elastomeric material 44. Alternately, the heel area 34 and the ball area 38 need not contain any recesses, in which case the elastomeric pads 44 and 46 may be placed directly on the upper part of the sole. In the heel area 34, a heel engaging structure 50 is provided. In lieu of having two separate pads, if desired, the substantially the entire upper surface can include a pad, even the arch area 36. The heel engaging structure 50 can comprise a section of material that extends upwardly and around the back of the sole portion and can act to capture the back of the heel cup of a shoe placed therein. The material is preferably soft and resilient, such as plastic, leather, vinyl, or some other material, such that when the shoe is placed in place, it captures the heel of a shoe placed therein. In order to provide for a better fit, a cut-away section 52 may be included at a lower portion of the heel engaging structure. Extending from the ball or front region of the sole in the area of the front recess 38 are engagement such as retention straps 60 and 62. The retention straps 60 and 62 are shown in their opened and unengaged mode. The retention straps 60 and 62 have detachable attachment elements, such as hook and loop material 64 and 66 (as shown in FIG. 3), respectively, snaps (not shown), adjustment buckles (not shown) and other known structure on each strap so that when in use the two retention straps 60 and 62 can be brought together and secured around a user's cleated shoe (not shown.) Since the ability to quickly put on and take off the cleat protector shoe cover 30 is desirable, detachably attachable retention straps 60 and 62 are useful. However, in lieu of providing a pair of opposed straps, a single, elastic retention strap that extends across the ball portion of a shoe cover can be provided, to which the user can slide into. Such an embodiment, not including a heel engaging structure, is shown and described further below with reference to FIG. 10.

FIG. 3 is a lower right side view of the exemplary cleat protector shoe cover 30 of the invention with its retention straps 60 and 62 unengaged from each other and in their open position, showing the hook and loop material 64 and 66, respectively. The heel engaging structure 50 and the sole 32 with heel area 34, arch area 36 and ball area 38 are shown.

Figure 4:
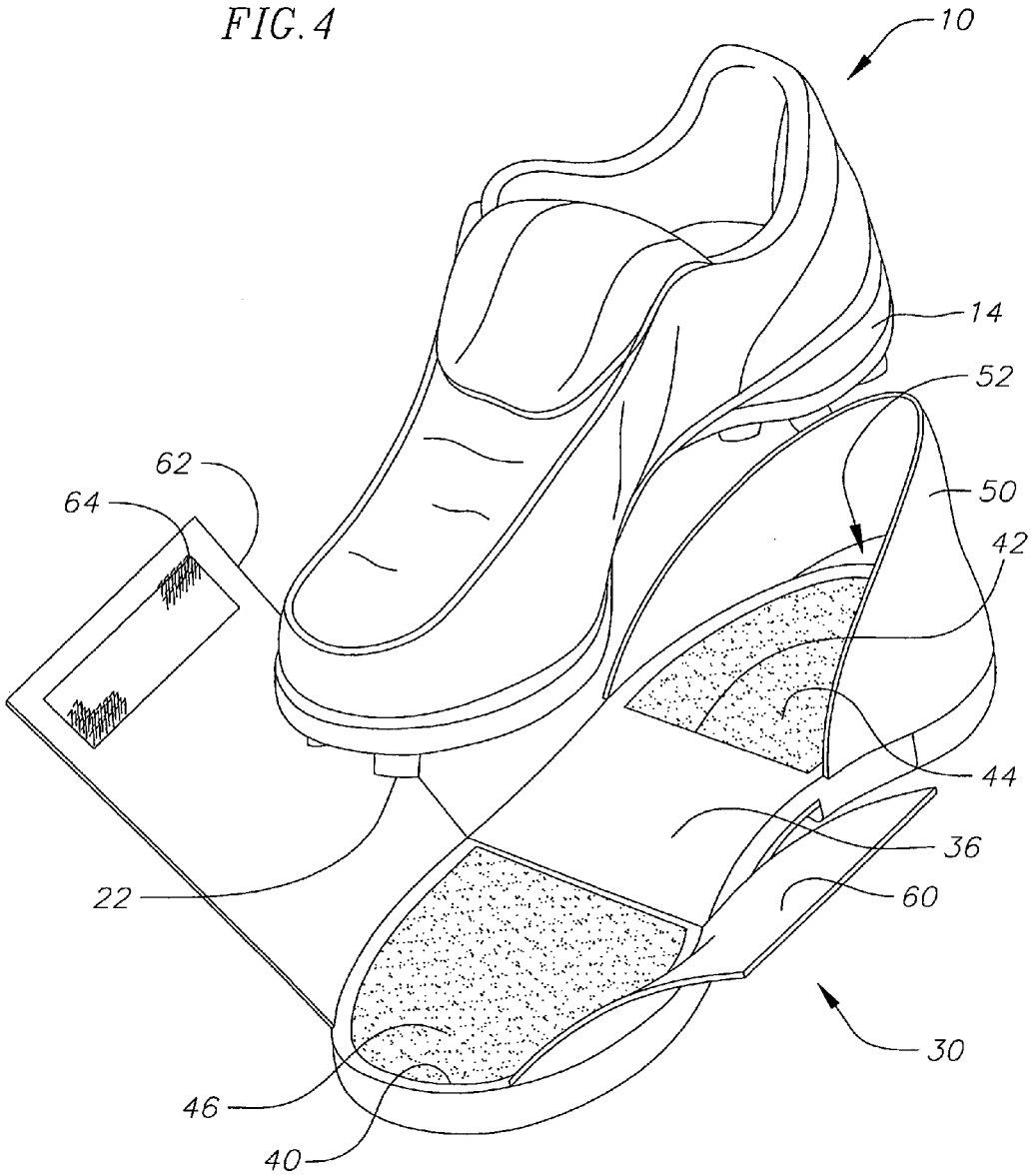
FIG. 4 is a top perspective of the exemplary cleated shoe of FIG. 1 positioned above the exemplary cleat protector shoe cover of FIG. 1.

FIG. 4 is a top perspective view of the exemplary cleated shoe 10 of FIG. 1 positioned above the exemplary cleat protector shoe cover 30 with the retention straps 60 and 62 being released to permit the shoe 10 to be inserted and removed. In this view, the elastomeric pads 44 and 46 are shown located in their respective recesses 40 and 42 and other features of the cleated shoe 10 and cleat protector shoe cover 30 are shown.

Figure 5:
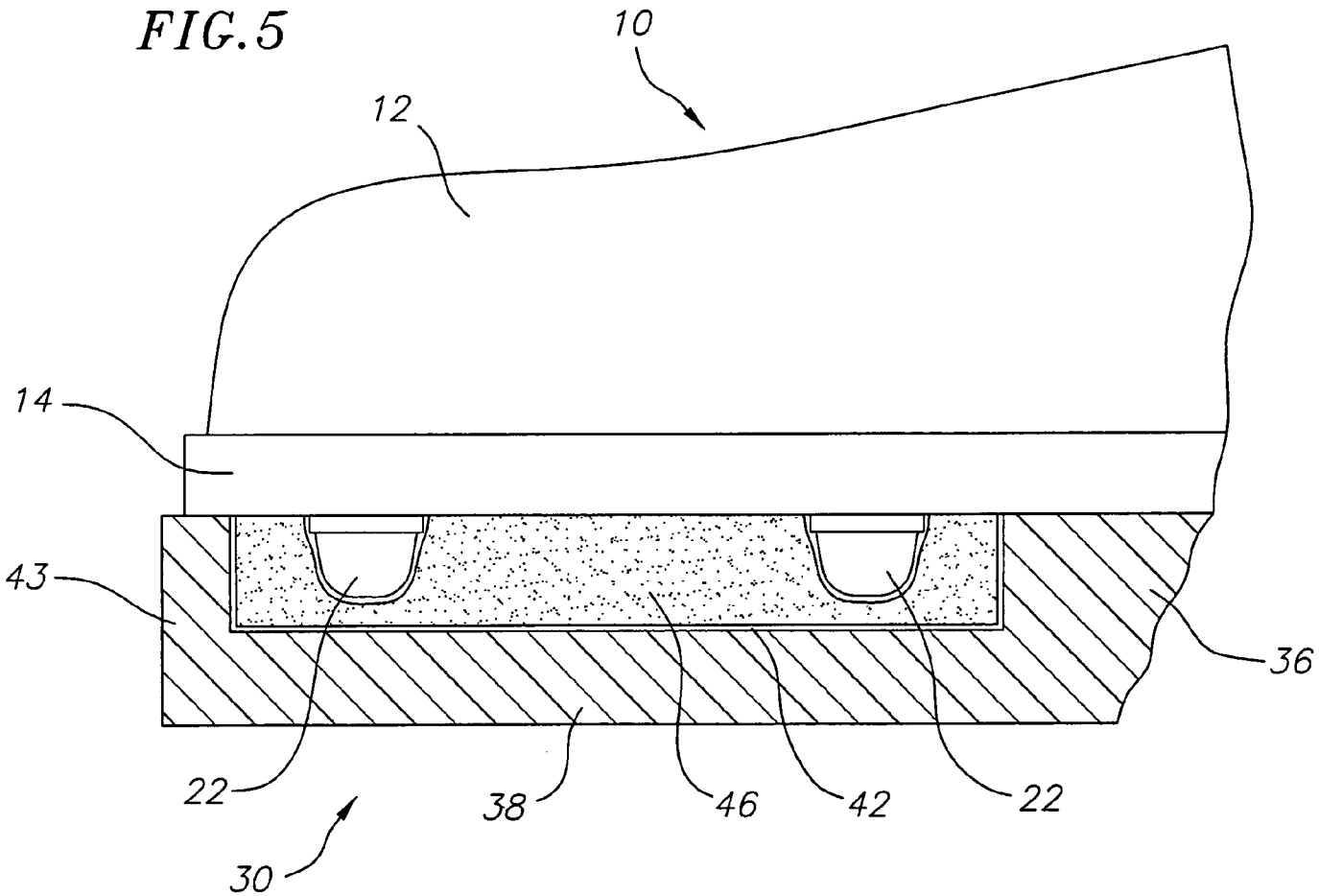
FIG. 5 is a partial cross-sectional view showing how the cleats extending from the sole on the front part of a cleated shoe engage with the cleat conforming pads of the cleat protector shoe cover.

FIG. 5 is a partial cross-sectional view showing how the cleats 22 extending from the sole 14 on the front part of a cleated shoe 10 with its upper 12, will compress into and conform to the elastomeric cleat forming pad 46 of cleat protector shoe cover 30, and how the arch area 36 need not be formed of soft elastomeric material, and can be formed of different material if desired, such as a harder plastic or rubber, and can act to support the arch area 18 of the cleated shoe. In this figure the engagement straps are removed for clarity of presentation. The fit of the elastomeric pad 46 is shown located in its recess 42.

Figure 6:
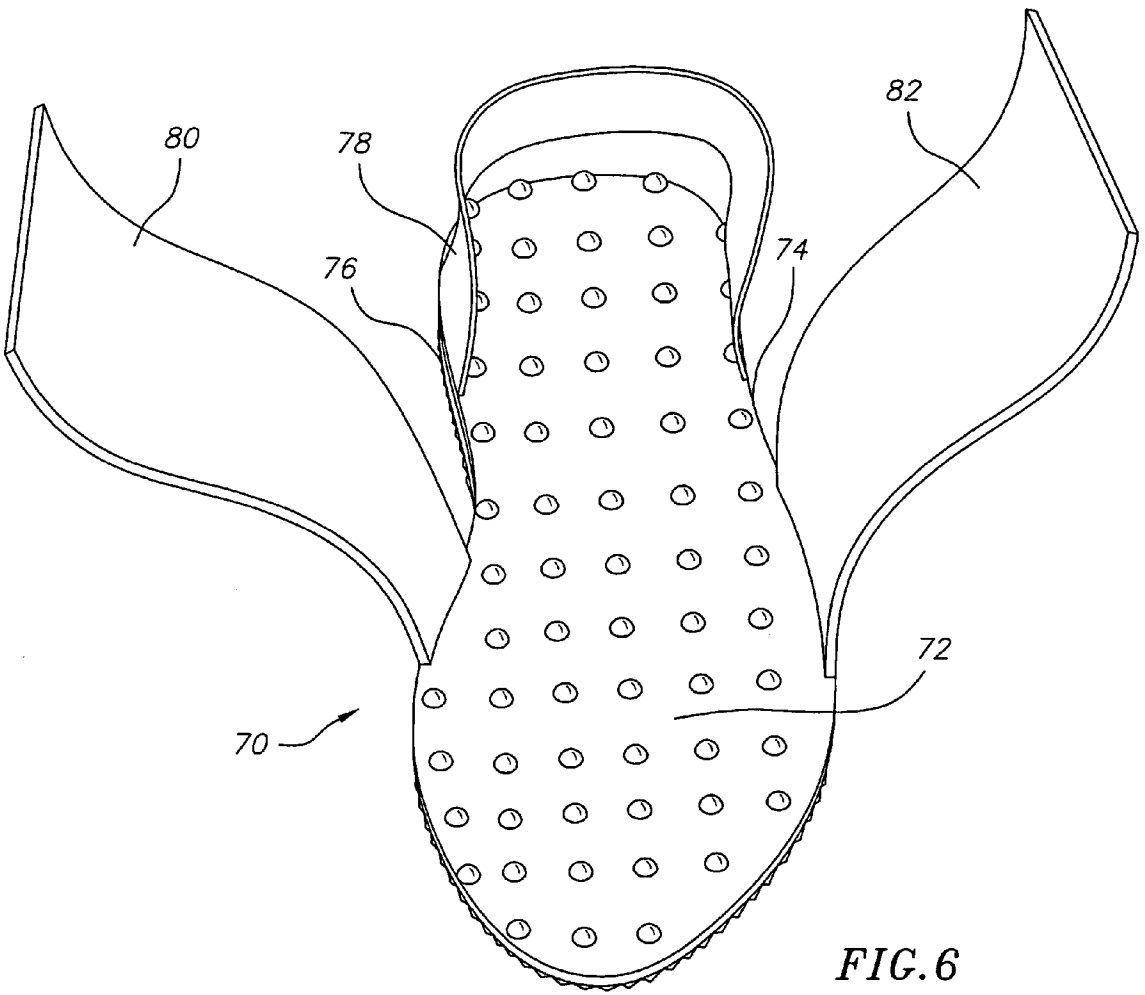
FIG. 6 is a front top perspective view of another exemplary embodiment of a cleat protector shoe cover.

FIG. 6 is a front top perspective view of another exemplary embodiment of a cleat protector shoe cover 70. It has a preferably soft and elastomeric upper layer 72, side edges 74, a relatively rigid sole portion 76 below the relatively soft and elastomeric upper layer 72, a heel engaging structure 78, and retention straps 80 and 82 which are preferably detachably attachable together by conventional means. Unlike the embodiment of FIGS. 2-5, if desired, the soft and elastomeric upper layer 72 may extend continuously over the entire upper surface of the cleat protector shoe cover 70 without interruptions in the arch areas. The upper layer 72 may have a textured upper surface to better capture the cleats of a shoe. Also, if desired, the upper layer 72 can be made material that is not particular soft and elastomeric so that the cleats do not sink in very much. The heel engaging structure 78 can comprise a section of material (e.g., in a strap-like manner) that extends upwardly and around the back of the sole portion and can act to capture the back of the heel cup of a shoe placed therein. The material is preferably soft and resilient, such as plastic, leather, vinyl, or some other material, such that when the shoe is placed in place, it captures the heel of a shoe placed therein. Engagements such as retention straps 80 and 82 extend from the ball or front region of the sole. The retention straps 80 and 82 are shown in their opened and unengaged mode. The retention straps 80 and 82 have detachable attachment elements, such as hook and loop material, snaps, adjustment buckles and other known structure on each strap so that when in use the two retention straps 80 and 82 can be brought together and secured around a user's cleated shoe (not shown.) Since the ability to quickly put on and take off the cleat protector shoe cover 70 is desirable, detachably attachable retention straps 80 and 82 are useful. However, in lieu of providing a pair of opposed straps, a single, elastic retention strap that extends across the ball portion of a shoe cover can be provided, to which the user can slide into.

Figure 7:
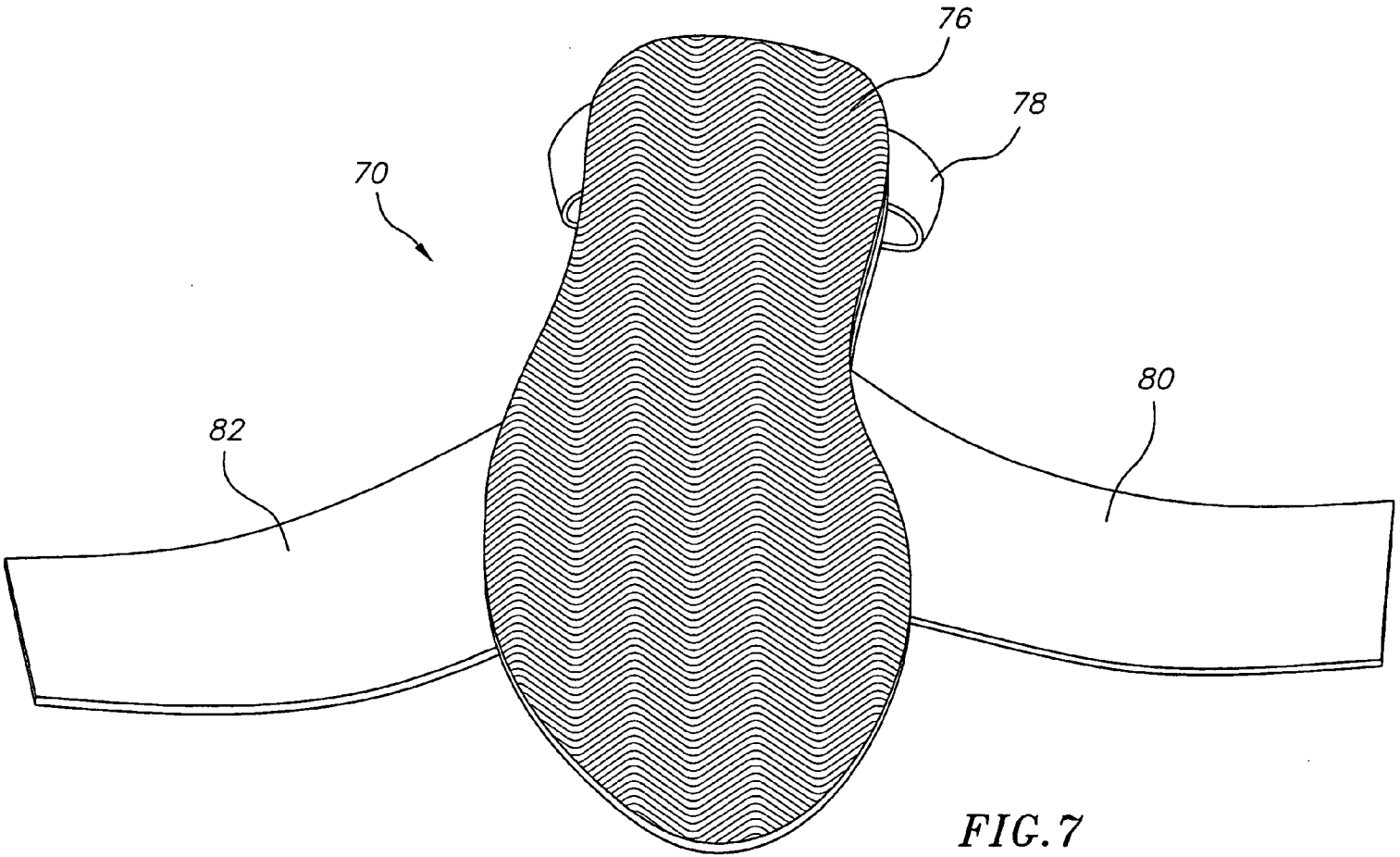
FIG. 7 is front bottom perspective view of the exemplary cleat protector shoe cover of FIG. 6.

FIG. 7 is front bottom perspective view of the exemplary cleat protector shoe cover 70 of FIG. 6. The sole portion 76 is shown, as are the heel engaging structure 78 and the retention straps 80 and 82.

Figure 8:
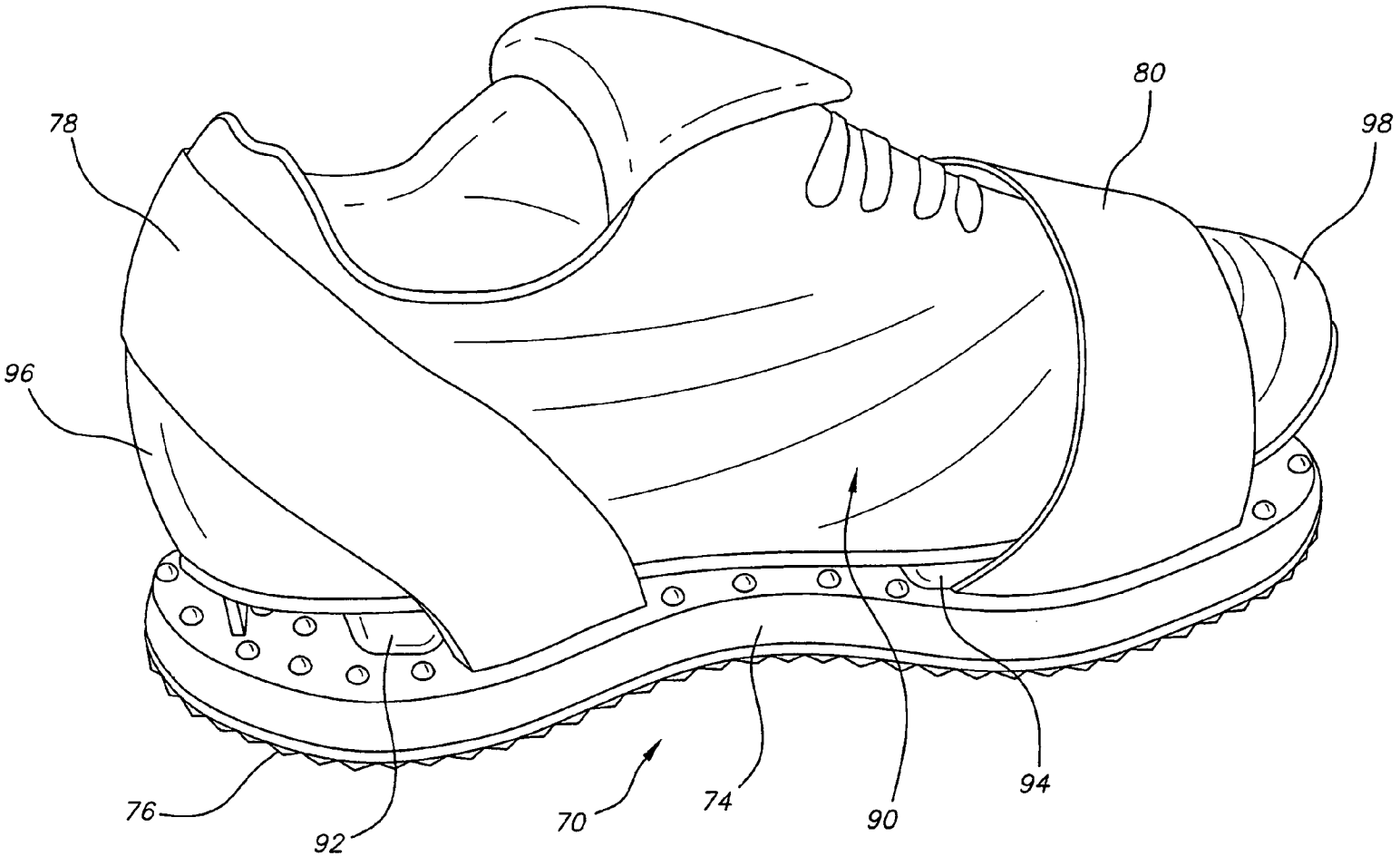
FIG. 8 is a side view of the cleat protector shoe cover of FIG. 6 used with a cleated shoe.
Figure 9:
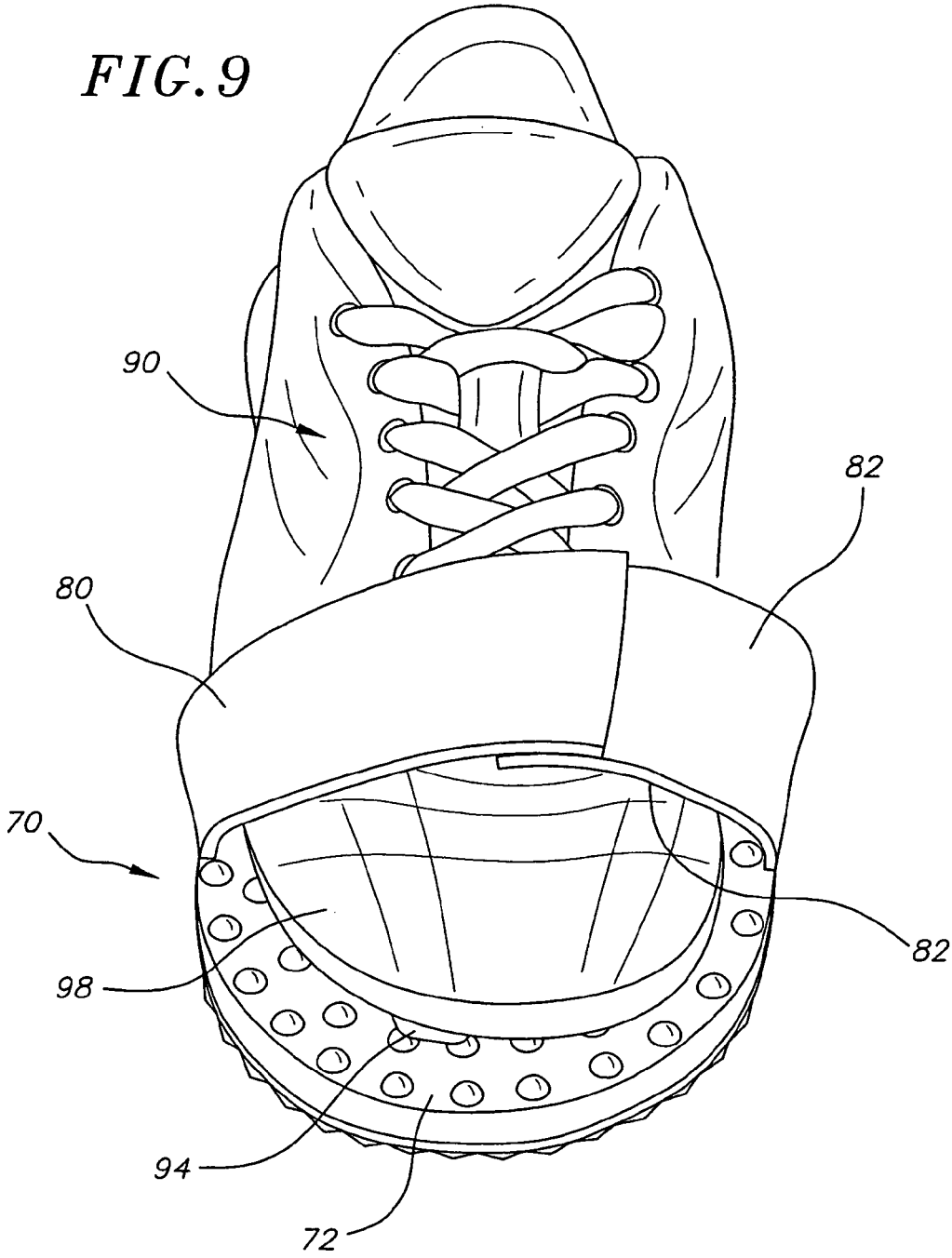
FIG. 9 is a front view of the cleat protector shoe cover of FIG. 6 used with a cleated shoe.

FIGS. 8 and 9 are a side view and front view, respectively, of the cleat protector shoe cover 70 of FIG. 6 used with a cleated shoe 90 with cleats 92 and 94 extending 74. As can be seen, the heel engaging structure 78 captures the heel 96 of the shoe 70 placed therein and the retention straps 80 and 82 capture the front region 98 of the shoe 70.

Figure 10:
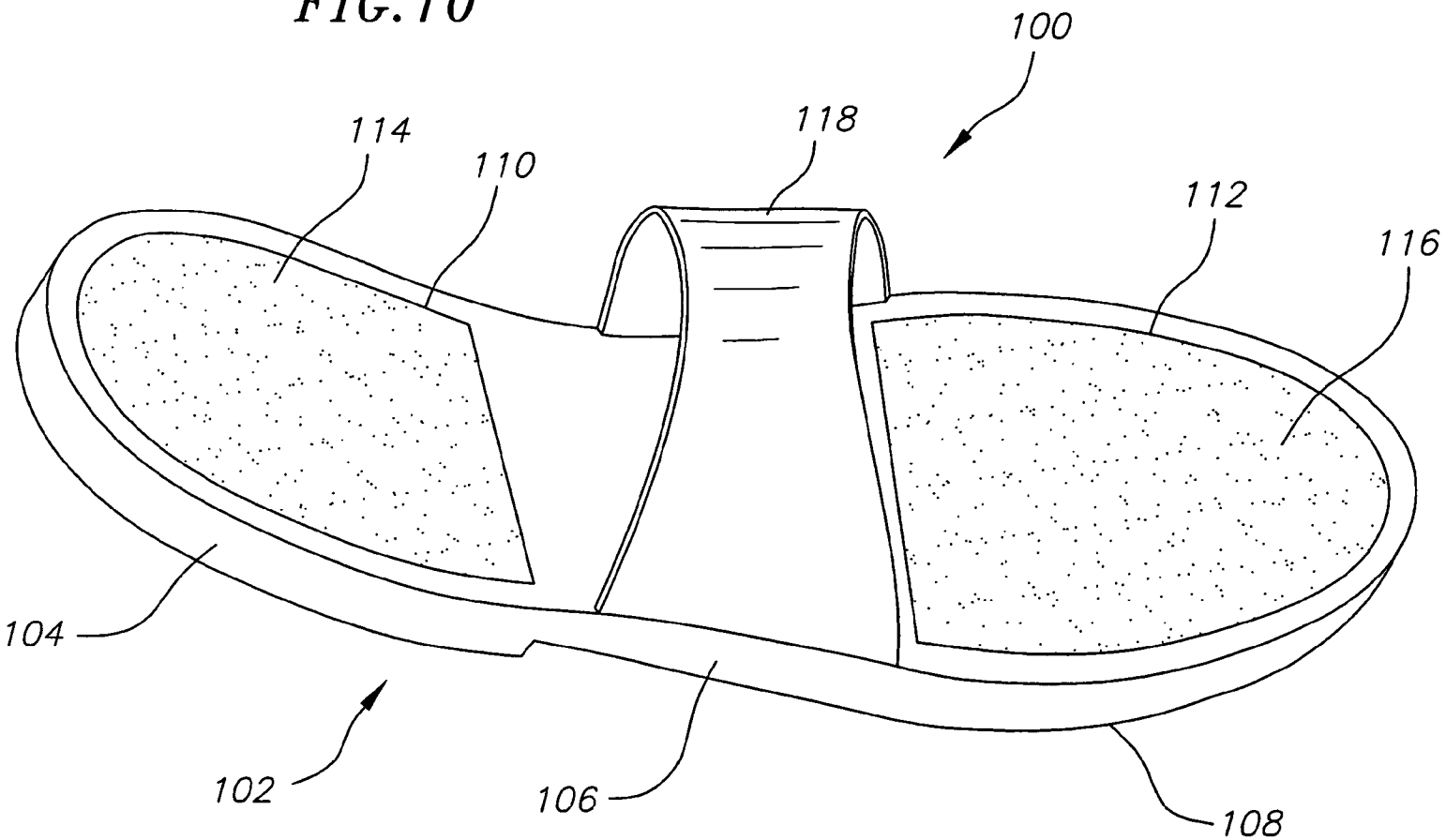
FIG. 10 is a top front perspective view of a further embodiment of the cleat protector shoe cover of the invention.

FIG. 10 is a top front perspective view of a further embodiment of the cleat protector shoe cover 100 of the invention. It has a sole 102 with a heel area 104, an arch (mid shoe) area 106, and a ball area 108. Recesses 110 and 112 for formed in the heel area 104 and the ball area 108 into which are elastomeric cleat conforming pads 114 and 116 are located and preferably are permanently attached within the recesses 110 and 112, respectively. In the alternative, the sole can be formed together with elastomeric cleat conforming pads 114 and 116 integrally formed therein, such as by molding the material of the elastomeric cleat conforming pads 114 and 116 with other parts of the sole 102. In the alternative, rather than including elastomeric cleat conforming material just in the heel and ball areas of the upper part of the sole, this elastomeric material can be included even in the arch area. The cleat protector shoe cover 100 has an engagement such as a retention strap 118. The retention strap is preferably formed of resilient material to permit a user to slip his or her cleated shoe therein. While a single retention strap is shown, two straps that detachably attachable together, such as shown FIGS. 2-4, can be used.

Figure 11:
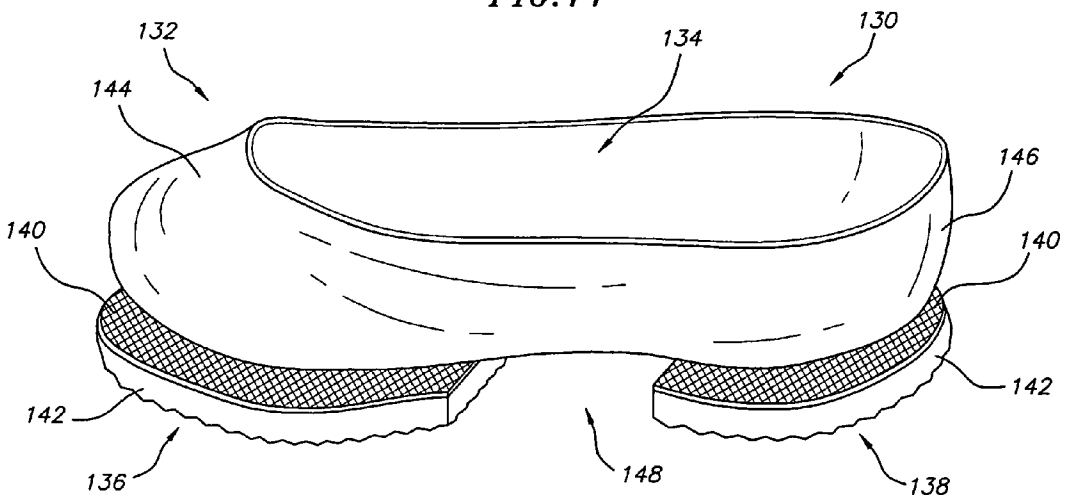
FIG. 11 is a side perspective view of yet a further embodiment of a size adjustable cleat protector shoe cover of the invention.

FIG. 11 is a side perspective view of yet a further embodiment of a size adjustable cleat protector shoe cover 130 of the invention. It has an upper portion 132 formed of elastic material, including elastomeric materials, rubber, silicone, neoprene, elasticized fabrics, and the like that is flexible and resilient. The upper portion 132 has a shoe opening 134 into which a person's foot wearing a cleated (or other) shoe can be inserted (not shown.) A ball area sole portion 136 and a heel area sole portion 138 are attached to underside areas of the upper portion 132. The ball area sole portion 136 and the heel area sole portion 138 may, if desired, have an upper surface material 140 that has different qualities than a lower material 142. For example, the upper surface material 140 may be stiffer and resilient to cleat penetration, whereas the lower material 142 can be softer and more flexible. The ball area sole portion 136 and the heel area sole portion 138 can be attached to the upper portion 132 by adhesive, sonic welding, stitching, and/or other mechanical methods, or by any other method. Alternatively, the upper portion 132 can be molded integrally together with the ball area sole portion 136 and/or the heel area sole portion 138, or the upper portion 132 is molded of the same material as the ball area sole portion 136 and/or the heel area sole portion 138. The upper portion 132 will preferably have a front portion 144 that is adapted to retain the front of a shoe and a rear portion 146 that is adapted to engage with a rear portion of the shoe. As noted above, the upper portion 132 is formed of elastic material, including elastomeric materials, rubber, silicone, neoprene, elasticized fabrics, and the like that is flexible and resilient, and is designed to fit around a wide variety of different shoes and engage the shoe with the ball area sole portion 136 and the heel area sole portion 138. Between the ball area sole portion 136 and the heel area sole portion 138 there is an intermediate area 148 which is unattached to other areas and which, due to its flexible nature, permits elongation of the size adjustable cleat protector shoe cover 130 to permit a single shoe cover to fit to a wide variety of shoe styles and sizes. Thus, rather that requiring that a cleat protector shoe cover be provided in discrete sizes that match to a particular shoe size (e.g., 11 D), the flexible nature of the size adjustable cleat protector shoe cover 130 permits great size and style adaptability to a variety of shoe styles and sizes.

Figure 12:
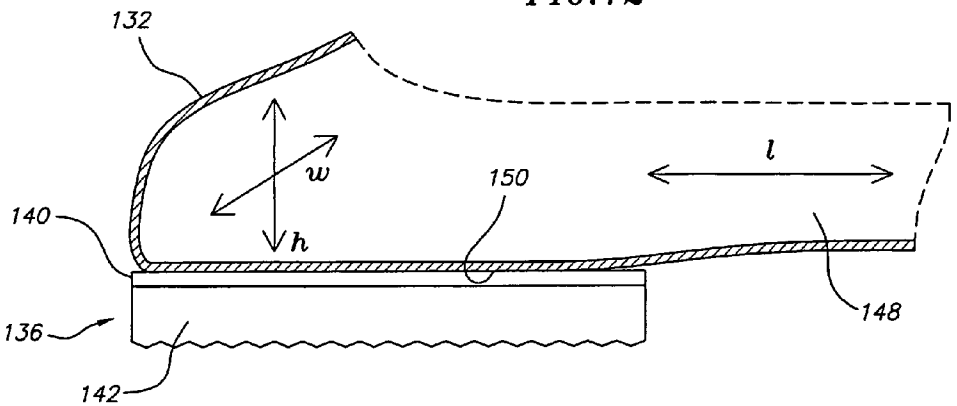
FIG. 12 is a detail showing a shell and outer sole of the size adjustable cleat protector shoe cover of FIG. 11.

FIG. 12 is a detail showing the upper portion 132 and the ball area sole portion 136 of the size adjustable cleat protector shoe cover 130 of FIG. 11. An upper surface material 140 and the lower material 142 of the ball area sole portion 136 are shown, as well as the intermediate area 148 which is unattached to other areas. An underside region 150 of the upper portion 132 is attached to the upper surface material 140. As shown by double ended arrowed lines h, w and l, the height h and width w of the size adjustable cleat protector shoe cover 130 is adjustable at all points of the shoe cover and the length l of the shoe cover is stretchable in the intermediate area 148.

Figure 13:
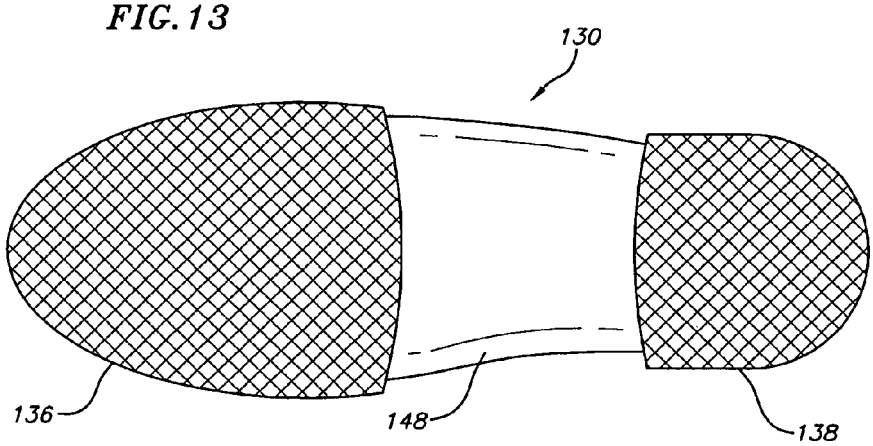
FIG. 13 is a bottom view of the size adjustable cleat protector shoe cover of FIG. 11.

FIG. 13 is a bottom view of the size adjustable cleat protector shoe cover 130 of FIG. 11, and shows the bottom of the intermediate regions 148 and the bottom of the ball area sole portion 136 and the heel area sole portion 138.

Figure 14:
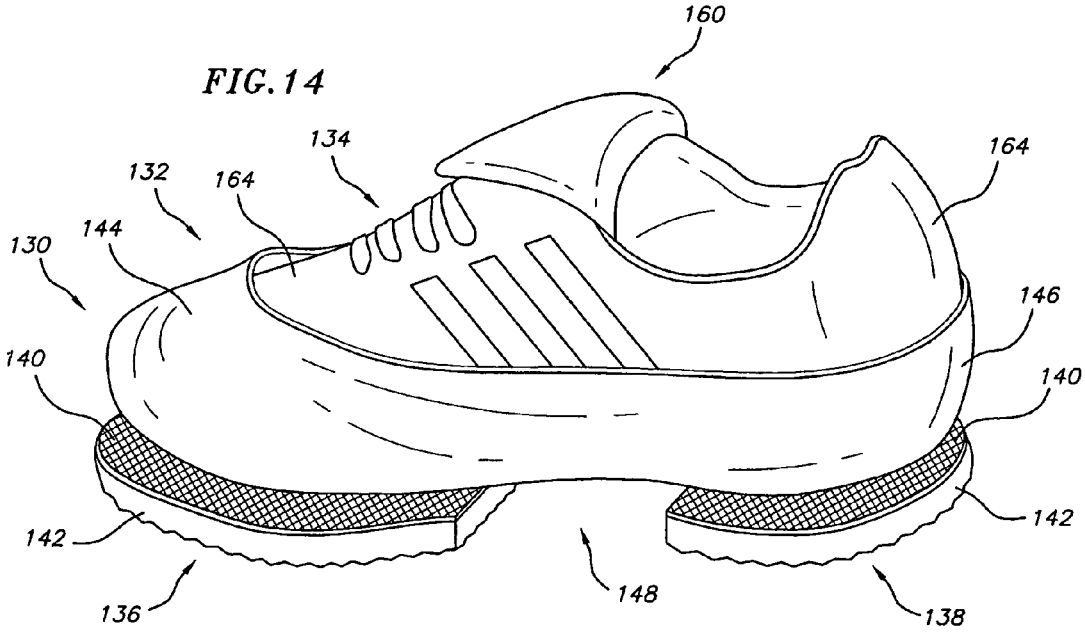
FIG. 14 is a side perspective view of the size adjustable cleat protector shoe cover of FIG. 11 shown with a cleat shoe inserted therein.

FIG. 14 is a side perspective view of the size adjustable cleat protector shoe cover 130 of FIG. 11 shown with a cleated shoe 160 (in phantom) inserted therein. As shown, the front portion 162 of the cleated shoe will be held by the front portion 144 and a heel portion 164 of the cleated shoe 160 fits in the rear portion 146. Other parts of the size adjustable cleat protector shoe cover 130 are as shown in FIG. 11.

Figure 15:
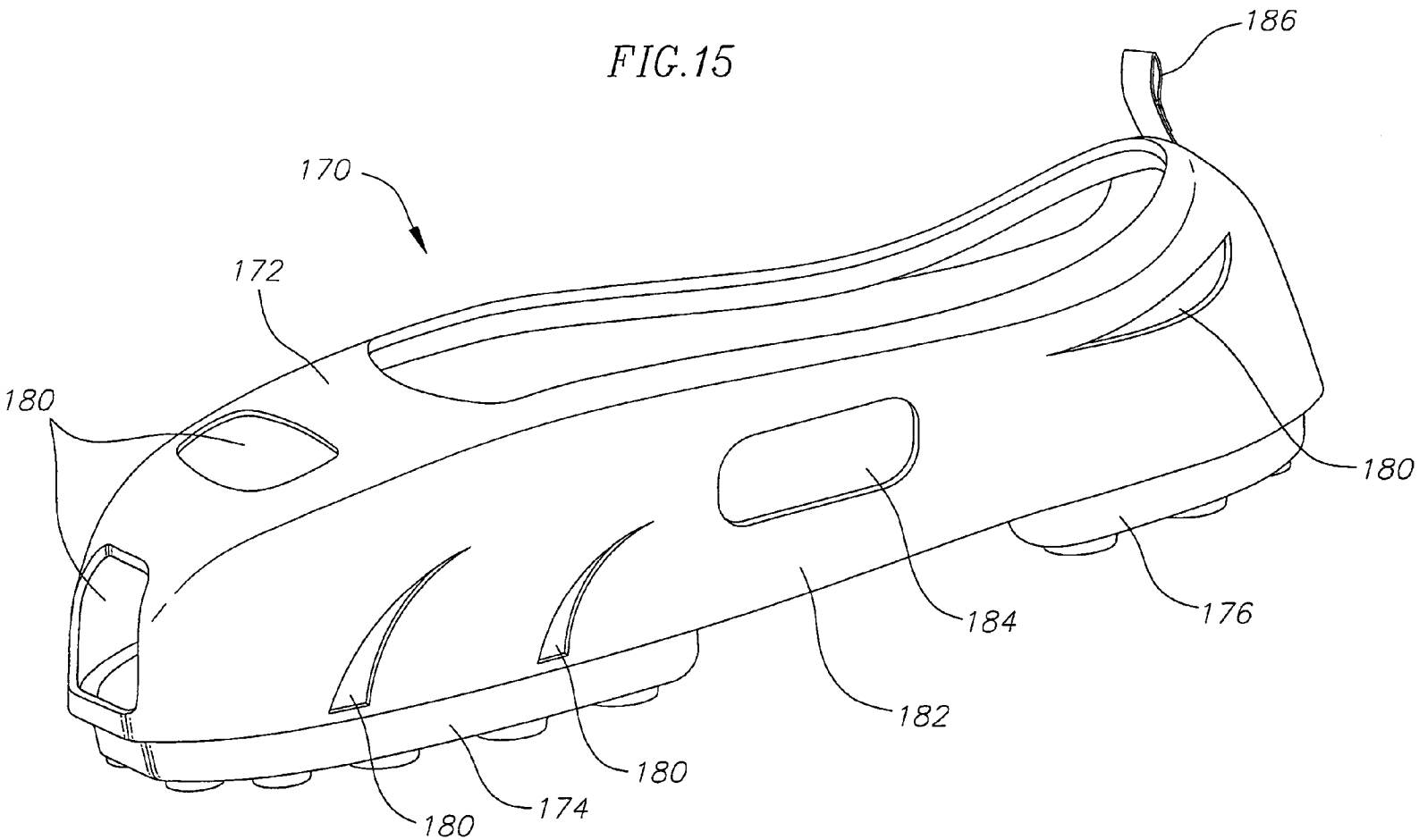
FIG. 15 is a top perspective view of another embodiment of a cleat protector shoe cover.

FIG. 15 is a side perspective view of yet another size adjustable cleat protector shoe cover 170, wherein an upper flexible portion 172 is integrally formed together with a ball area sole portion 174 and the heel area sole portion 176. The upper flexible portion 172 can have openings 180 formed therebetween. The openings 180 can function to permit greater stretchability of the upper flexible portion 172. The ball area sole portion 174 and the heel area sole portion 176 are thicker than the joined sections 178 and therefore can be less stretchable. While the size adjustable cleat protector shoe cover 170 can be formed of a single material, it is also possible and preferable to form at least portions of the ball area sole portion 174 and the heel area sole portion 176 (e.g., their bottoms) of harder and less flexible material for greater durability. This can be done by conventional molding techniques. An intermediate portion 182 of the cleat protector shoe cover 170 will preferably be stretchable to permit a good fit to a variety of cleated shoe sizes and styles, and an opening 184 can preferably be located in the vicinity of the intermediate portion to aid stretchability. A heel pull tab 186 can be provided to assist in donning and removing the cleat protector shoe cover 170.

Figure 16:
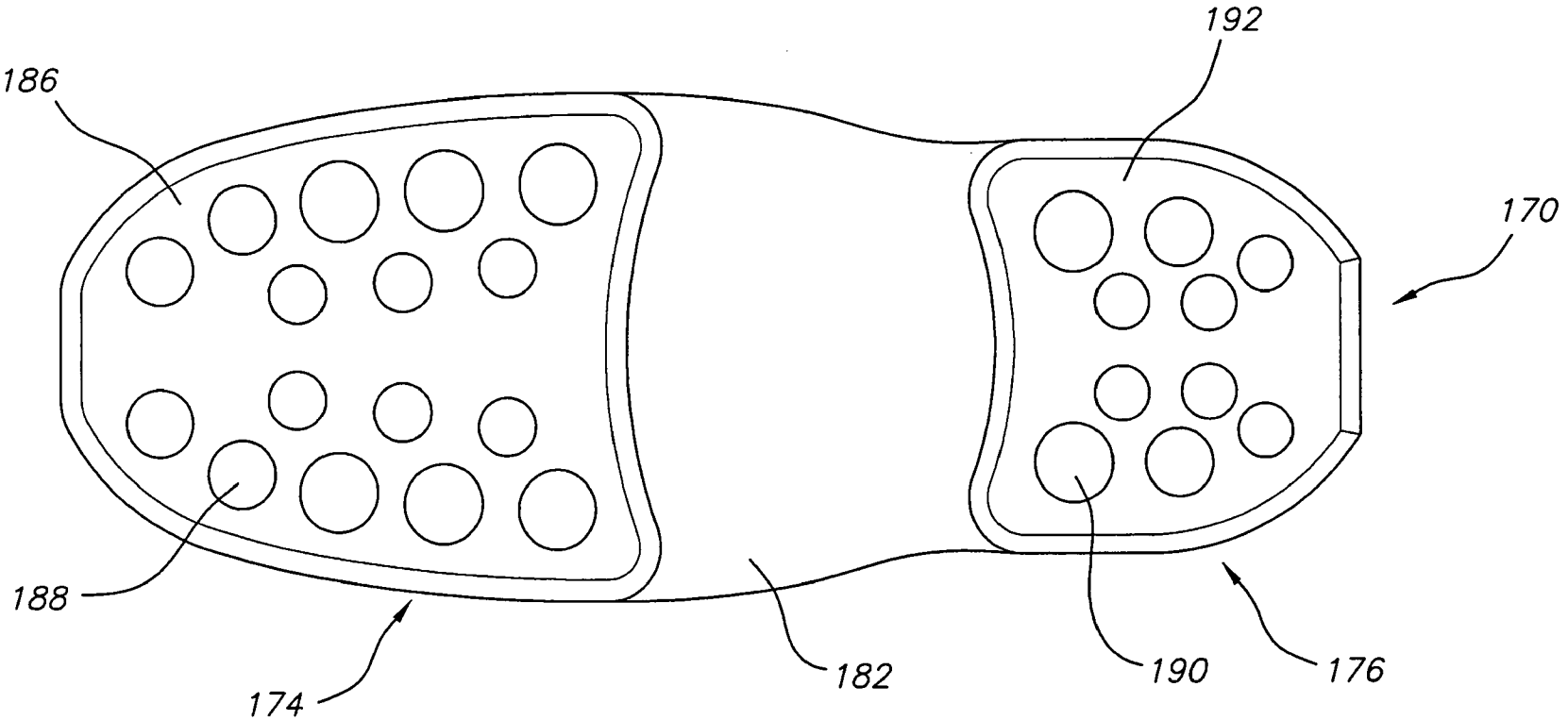
FIG. 16 is a bottom plan view of the cleat protector shoe cover of FIG. 15.

FIG. 16 is a bottom view of the size adjustable cleat protector shoe cover 170, and shows the ball area sole portion 174 and the heel area sole portion 176 and the arch area 182. Contours and/or protrusions 188 can be extend from a bottom 186 of the ball area sole portion 174 and similarly contours and/or protrusions 190 can be extend from a bottom 192 of the heel area sole portion 176.

Thus, the cleat protector shoe covers 30, 70, 100, 130, and 170 will provide an effective and easy to use cover that allows a cleated shoe user to easily put them on and take them off. While it is preferably that the cleat protector shoe covers 30, 70, 100, 130, and 170 be size adjustable, it is not absolutely required, and they can be made in a greater variety of sizes and shapes to closely conform to a given shoe style and size. Also, while the cleat protector shoe covers 30, 70, 100, 130, and 170 are particularly well suited to cleated shoes, they can be used even with non-cleated shoes, such as when a person wishes to wear his or he shoes indoor but protect flooring from tracked in dirt, etc.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive.

What is claimed is:

1. A cleat protector shoe cover for use with cleated shoes, comprising:

an upper portion comprising elastic material and having a shoe opening formed in a top thereof, a ball area at a front portion thereof, a heel area at a rear portion thereof, and an intermediate area between the ball area and the heel area;

a ball area sole portion that is located at a lower side of the ball area of the upper portion;

a heel area sole portion that is located below the upper portion at a rear portion thereof at a lower side of the heel area of the upper portion; and an intermediate portion comprising an underside region of the upper portion located between the ball area sole portion and the heel area sole portion, wherein the intermediate portion is longitudinally stretchable, and wherein neither the ball area sole portion, the heel area sole portion, nor the intermediate portion have any openings formed therein, and wherein an upper surface of the ball area sole portion and an upper surface of the heel area sole portion are formed of stiffer and more resilient to cleat penetration material than is the intermediate portion, which intermediate portion remains more stretchable than the ball area sole portion and the heel area sole portion.

2. The cleat protector shoe cover of claim 1, wherein the ball area sole portion and the heel area sole portion are integrally formed with the upper portion.

3. The cleat protector shoe cover of claim 1, wherein the cleat protector shoe cover is formed of one of rubber, silicone, neoprene, and/or elasticized fabrics.

4. The cleat protector shoe cover of claim 1, wherein the upper portion is stretchable along its height and width above the ball area sole portion and the heel area sole portion, and wherein the upper portion is stretchable along its height, width, and length in the intermediate portion.

* * * * *